US006023911A

United States Patent [19]

Elvers et al.

[11] Patent Number: 6,023,911

[45] Date of Patent: Feb. 15, 2000

[54] APPARATUS FOR TRANSPORTING WEBS OF WRAPPING MATERIAL

[75] Inventors: Olaf Elvers, Lauenburg; Eric Jürgens, Hamburg; Frank Syrzisko, Schwarzenbek, all of Germany

[73] Assignee: Topack Verpackungstechnik GmbH, Germany

[21] Appl. No.: 08/969,084

[22] Filed: Nov. 12, 1997

[30] Foreign Application Priority Data

Dec. 4, 1996 [DE] Germany ..... 196 50 182

[51] Int. Cl.[7] ..... B65B 41/00

[52] U.S. Cl. ..... 53/389.5; 53/228; 53/389.3

[58] Field of Search ..... 53/389.5, 389.3, 53/228, 229, 230, 231, 586; 226/95, 109; 271/276, 197; 83/402, 422, 409

[56] References Cited

U.S. PATENT DOCUMENTS

| | | | |
|---|---|---|---|
| 2,597,877 | 5/1952 | LeClair | 53/230 |
| 2,930,173 | 3/1960 | Labine et al. . | |
| 3,222,844 | 12/1965 | Smith et al. | 53/228 |
| 4,495,746 | 1/1985 | Focke et al. . | |
| 4,524,658 | 6/1985 | Focke et al. . | |
| 4,999,967 | 3/1991 | Hoffman | 53/64 |
| 5,327,702 | 7/1994 | Taylor . | |
| 5,386,679 | 2/1995 | Boriani et al. | 53/461 |
| 5,535,573 | 7/1996 | Focke et al. | 53/201 |

FOREIGN PATENT DOCUMENTS

| | | |
|---|---|---|
| 0545265 A2 | 6/1993 | European Pat. Off. . |
| 0574788 | 12/1993 | European Pat. Off. . |
| 3131687 A1 | 3/1983 | Germany . |
| 3241636 A1 | 5/1984 | Germany . |
| 3800432 A1 | 7/1989 | Germany . |
| 4225452 A1 | 2/1993 | Germany . |
| 4134646 A1 | 4/1993 | Germany . |
| 2213456 | 8/1989 | United Kingdom . |

OTHER PUBLICATIONS

German Search Report dated Apr. 29, 1997.

*Primary Examiner*—Daniel B. Moon

*Attorney, Agent, or Firm*—Venable; George H. Spencer; Robert Kinberg

[57] ABSTRACT

A web of wrapping material for use in a cigarette packing machine is drawn off a roll and is advanced lengthwise, first by a single pneumatic belt conveyor which attracts an intermediate portion of the web, and thereupon by two additional pneumatic conveyors each of which attracts one of the two marginal portions of the web. The web is severed by a cross cutter between the first conveyor and the additional conveyors to yield a series of successive blanks, and such blanks are draped around successive arrays of unwrapped cigarettes or around successive cigarette packets which are advanced across the path for successive wrappers between the two additional conveyors.

16 Claims, 1 Drawing Sheet

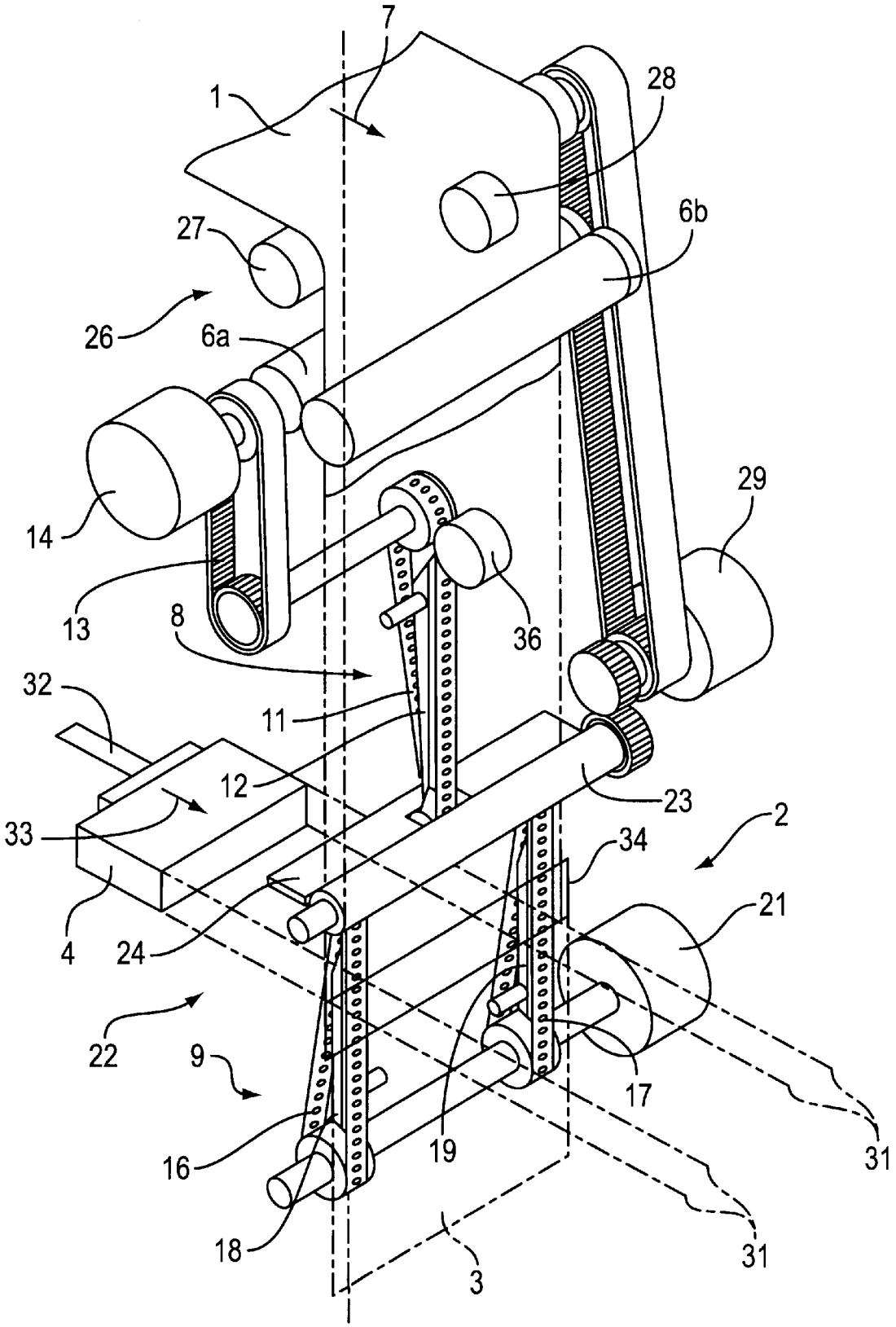
7
1
28
27
6b
26
6a
29
14
13
8
36
32
11
12
23
33
2
34
4
24
21
22
9
17
16
19
31
18
31
3

APPARATUS FOR TRANSPORTING WEBS OF WRAPPING MATERIAL

BACKGROUND OF THE INVENTION

The invention relates to improvements in apparatus for transporting webs or strips of paper, plastic sheet stock or metallic foils, and more particularly to improvements in apparatus for transporting webs of sheet material which can be converted into a series of blanks for use in conjunction with the making or wrapping of packets of cigarettes or other types of smokers' products. Still more particularly, the invention relates to improvements in methods of and in apparatus for transporting webs of wrapping material in such a way that a web which is to be converted into a series of successive blanks is advanced along a predetermined path by at least two conveying units including (a) an upstream conveying unit and (b) a downstream conveying unit employing two pneumatic suction band conveyors which engage and entrain the two marginal portions of the web.

The making of satisfactory packets for arrays of plain or filter cigarettes in a cigarette packing machine renders it necessary to advance the wrapping or packing material (normally in the form of webs or strips which are to be subdivided into a series of successive blanks of a prescribed size and shape) with a very high degree of accuracy, predictability and reproducibility. This ensures that a packing machine can turn out short or long series of identical eye-pleasing packets regardless of the number of envelopes or layers in a packet and irrespective of whether the rod-shaped articles are confined in so-called soft packs, in so-called hinged lid packs or any other selected forms of receptacles. Predictable conveying of continuous and subdivided webs or strips of wrapping material is particularly important during certain specific stages of a cigarette wrapping or packet making operation, as well as in connection with the conveying of certain types of highly sensitive wrapping material such as webs of metallic foil (normally or often aluminum foil) which are or which can be draped directly around arrays of plain or filter cigarettes prior to confinement of such arrays in cardboard boxes serving for the making of hinged lid packs.

It is equally important to properly manipulate certain very thin and highly sensitive webs or strips of plastic material, such as transparent plastic material which is utilized for the making of outermost envelopes or layers; such layers are often provided with so-called tear strips to facilitate rapid and convenient removal of the outer envelopes when a purchaser desires to gain access to the contents of a cigarette packet. The outer envelopes are often made of polypropylene foil which is designed to preserve the aroma and/or to prevent changes in the moisture content of cigarettes or other rod-shaped smokers' products.

Commonly owned U.S. Pat. No. 4,999,667 to Gottfried Hoffmann discloses an apparatus wherein a web of wrapping material to be converted into blanks for the making of cigarette packets is advanced lengthwise from a roll or another suitable source along a predetermined path by a first suction-operated conveying unit having two spaced-apart foraminous conveyor bands each serving to attract and advance one of the two marginal portions of the web, and thereupon by a second suction-operated conveying unit which is a mirror image of the first conveying unit and also employs two spaced-apart foraminous conveyor bands each attracting and entraining one of the two marginal portions of the web downstream of the first conveying unit. A cross cutter is located between the two conveying units to subdivide the web into a series of successive blanks which are engaged by successive packets and are draped around the respective packets while the packets are caused to cross the path of the blanks between the foraminous bands of the second conveying unit. Successive packets, with the respective blanks partially draped around them, are propelled into successive chambers at the periphery of an indexible turret in the packing machine, and the conversion of blanks into outer envelopes of the packets is completed while the packets are confined in the chambers of the turret.

It has been ascertained that, though the patented apparatus operates quite satisfactorily, the material of the web is likely to develop fold lines, wrinkles, creases and/or to undergo other undesirable deformation during transport from the first to the second conveying unit, especially if the web is made of thin aluminum foil or of thin plastic (such as polyethylene) foil. The development of wrinkles, creases or the like detracts from the appearance as well as from the aroma and/or moisture preserving quality of the respective envelopes.

The disclosure of the U.S. Pat. No. 4,999,667 to Hoffmann is incorporated herein by reference.

A different web transporting apparatus is disclosed in European patent No. 0 545 265 A2. This apparatus employs a first suction-operated web conveying unit with three parallel foraminous band conveyors disposed between two knives which serve to cut into the marginal portions of the advancing web. The first conveying unit is followed by a second conveying unit employing a succession of pairs of suction-operated pincers or tongs which engage the front corners of the web and are mounted on two driven endless belts flanking the sides of the path for the web. The purpose of the tongs is to pull the web to a station where successive portions of the web are propelled or otherwise forced into the range of deforming instrumentalities. The just described apparatus transports the web from a lower level to a higher level, and each of a series of successively formed blanks (which are obtained in response to repeated severing of the web by a cross cutter) is suspended on the respective pair of suction-operated tongs. A drawback of this proposal is that the retention of successive blanks in optimum positions is least likely in the region of the second conveying unit, i.e., exactly in the region where the blanks are to be guided with utmost precision in order to ensure optimal draping around arrays of cigarettes or around partially finished cigarette packets.

OBJECTS OF THE INVENTION

An object of the invention is to provide an apparatus which can advance webs of sensitive sheet material with a higher degree of accuracy and reliability than heretofore known apparatus.

Another object of the invention is to provide the apparatus with a novel and improved combination of web conveying units.

A further object of the invention is to provide a packing machine, such as a cigarette packing machine, which embodies at least one apparatus of the above outlined character.

An additional object of the invention is to provide an apparatus wherein the transfer of a web or strip from conveying unit to conveying unit is more predictable and more satisfactory than in heretofore known apparatus including those disclosed in U.S. Pat. No. 4,999,967 and in European patent No. 0 545 265 A2.

Still another object of the invention is to provide an apparatus which is less likely to cause the development of wrinkles, creases and/or other undesirable deformations or defects in webs of highly sensitive metallic and/or plastic material than heretofore known apparatus which are utilized in cigarette confining and other types of wrapping or packing machines.

A further object of the invention is to provide a simple, compact and reliable apparatus which can be utilized in cigarette packing machines as a superior substitute for heretofore known and utilized web advancing, subdividing and wrapping apparatus.

Another object of the invention is to provide a novel and improved method of advancing webs or strips of wrapping material, particularly in cigarette packing machines, either for conversion into wrappers which immediately surround arrays of rod-shaped articles or into envelopes for packets containing arrays of rod-shaped articles.

An additional object of the invention is to provide a novel and improved method and a novel and improved apparatus which can be utilized to advance and/or to otherwise manipulate webs of highly sensitive material, particularly webs of extremely thin plastic or metallic material, in machines which are designed to turn out huge quantities of packets or other types of receptacles or containers for products of the tobacco processing industry.

Still another object of the invention is to provide a novel and improved method of preventing wrinkling, creasing and/or other undesirable deformation of a running web of wrapping material or the like in transition zones between successive web advancing or conveying units, especially between successive sucton-operated web conveying units.

A further object of the invention is to provide a novel and improved conveying unit which is designed to advance a continuous running web into the range of a cross cutter or an analogous web severing device in a packing machine for rod-shaped and/or other types of products, such as plain or filter cigarettes, cigars, cigarillos, papyrossi or cheroots.

Another object of the invention is to provide an apparatus wherein conventional web conveying means are combined and cooperate with novel web conveying means in a novel, improved and unobvious manner.

SUMMARY OF THE INVENTION

One feature of the invention resides in the provision of an apparatus for transporting an elongated web or strip (hereinafter called web) having spaced-apart first and second marginal portions and an intermediate portion between the marginal portions. The web is to be transported in a predetermined direction (e.g., downwardly) along a predetermined path, and the improved apparatus comprises a first conveying unit including first and second driven endless pneumatic band conveyors adjacent to and arranged to advance the respective (first and second) marginal portions of the web by suction in the predetermined direction along a first portion of the predetermined path. In accordance with a feature of the invention, the apparatus further comprises a second conveying unit which is adjacent a second portion of the predetermined path upstream of the first portion of such path, as seen in the predetermined direction, and is arranged to engage and entrain in the predetermined direction the aforementioned intermediate portion of the web. In accordance with a presently preferred embodiment of the invention, the second conveying unit engages the intermediate portion at least substantially midway between the first and second marginal portions of the web in the predetermined path.

The web can consist of a packing material for smokers' products, e.g., of thin aluminum foil or thin polyethylene foil, i.e., the first and second conveying units can form part of a packing machine for smokers' products.

The second conveying unit can be disposed at one side of the intermediate portion of the web (e.g., at the same side as the conveyors of the first conveying unit) in the predetermined path, and the apparatus can further comprise means for biasing the intermediate portion of the web against the second conveying unit. The biasing means can be located at the other side of the intermediate portion of the web in the second portion of the predetermined path.

The second conveying unit can comprise at least one endless belt having a web-contacting reach or stretch adjacent the intermediate portion of the web in the second portion of the predetermined path and serving to advance the web toward the first portion of the predetermined path. The aforementioned reach or stretch of the endless belt is preferably elongated and extends in the predetermined direction. The at least one endless belt is or can be foraminous (i.e., permeable to a fluid) , and the second conveying unit then further comprises means for (preferably pneumatically) attracting the intermediate portion of the web in the second portion of the predetermined path to the foraminous belt.

The apparatus preferably comprises first drive means for the conveyors of the first conveying unit, and discrete second drive means for the at least one endless belt of the second conveying unit.

Still further, the apparatus preferably comprises a suitable cross cutter for the web in the predetermined path, and such cross cutter is preferably operative between the first and second portions of the predetermined path. The first portion of the predetermined path can immediately follow the second portion of such path, and the cutter is preferably operative to sever the web at predetermined intervals so that the web yields a series of successive blanks. Such apparatus preferably further comprises means for converting successive blanks of the series into (inner or outer) wrappers for arrays of rod-shaped articles, such as plain or filter cigarettes.

The converting means comprises means (such as a reciprocable pusher) for advancing successive arrays of a series of arrays against successive blanks of the series of blanks along a second path extending across the first portion of the predetermined path. Such converting means can further comprise means (e.g., one or more suitably configurated mouthpieces) for draping successive blanks of the series of blanks around the respective arrays in the second path. The arrays of rod-shaped articles can constitute groups of cigarettes confined in packets which are to be confined in the blanks (e.g., transparent plastic blanks). Alternatively, the arrays can constitute groups of cigarettes which are to be confined in the respective blanks, e.g., in blanks of metallic foil.

The novel features which are considered as characteristic of the invention are set forth in particular in the appended claims. The improved apparatus itself, however, both as to its construction and its mode of operation, together with numerous additional important and advantageous features thereof, will be best understood upon perusal of the following detailed description of certain presently preferred specific embodiments with reference to the accompanying drawing.

BRIEF DESCRIPTION OF THE DRAWING

The single FIGURE of the drawing is a partly schematic fragmentary perspective view of an apparatus which embodies one form of the invention and forms part of a machine for packing block-shaped commodities.

DESCRIPTION OF PREFERRED EMBODIMENTS

The single FIGURE shows an apparatus which can transport, subdivide into blanks and convert into discrete envelopes or wrappers an elongated web 1 of suitable wrapping material (such as paper, plastic foil, metallic foil or a laminate of two or more layers of identical or different sheet materials). The web 1 is drawn off a roll or another suitable source (not shown) and is advanced in the direction indicated by an arrow 7, namely from a higher level to a lower level (the same as shown in the aforementioned commonly owned U.S. Pat. No. 4,999,967 to Hoffmann). In the downwardly extending portion of its path, the web 1 is repeatedly severed at a station 2 by a cross cutter 22 to yield a series of successive discrete rectangular or square blanks 3. Successive blanks 3 are draped around successive packets 4 e.g., packets containing arrays of twenty plain or filter cigarettes in the customary quincunx formation.

For example, the web 1 can consist of a thin plastic foil of polypropylene. Such material can yield blanks 3 which can be draped around otherwise finished packets 4 of plain or filter cigarettes to preserve the aroma and the moisture content of the confined arrays of rod-shaped smokers' products.

The means for actually drawing the web 1 off a roll on a spool of the like comprises two cooperating advancing rollers 6*a,* 6*b* which engage the respective sides of the web and pull it in the direction of the arrow 7. Successive increments of the web 1 are thereupon engaged and conveyed in the direction of the arrow 7 first by a conveying unit 8 and thereupon by a conveying unit 9. The unit 9 immediately follows the unit 8, and the cross cutter 22 is operative between these units.

In accordance with a feature of the invention, the conveying unit 8 comprises an endless foraminous belt 11 having an elongated web contacting, attracting and entraining run or stretch extending in the direction of the arrow 7 (i.e., in the direction of advancement of the web 1) and engaging an intermediate portion of the web, preferably at least substantially midway between the two spaced-apart longitudinally extending marginal portions of the web. The just mentioned reach or stretch of the belt 11 contacts the rear side of the web 1, as viewed in the FIGURE, and can extend practically all the way to the cross cutter 22. The means for pneumatically attracting the intermediate portion of the web 1 to the adjacent reach of the foraminous belt 11 of the conveying unit 8 comprises a suction chamber 12 which is adjacent the rear or inner side of the web-attracting reach of the belt 11 and is connected to the suction side of a fan or any other suitable suction generating device, not shown.

The drive means for the belt 11 comprises a toothed belt 13 driven by an electric motor 14 or another suitable prime mover. The illustrated motor 14 further serves to rotate the advancing roller 6*a* in such a way that the peripheral speed of the rollers 6*a,* 6*b* matches the speed of the foraminous belt 11.

The conveying unit 9 comprises two endless pneumatic (foraminous) suction band conveyors 16, 17 which engage the adjacent marginal portions of the web 1 (actually of successive blanks 3) immediately downstream of the cross cutter 22. Those reaches of the bands 16, 17 which are adjacent to and attract and advance successive blanks 3 in the direction of the arrow 7 respectively cooperate with suction chambers 18, 19 which, in turn, are in communication with a common suction generating device or with discrete suction generating devices, not shown.

It will be seen that the bands 16, 17 of the conveying unit 9 flank the station 2 immediately downstream of the cross cutter 22. The means for driving the bands 16, 17 independently of the belt 11 comprises a discrete prime mover 21 (e.g., an electric motor).

A comparison of the improved apparatus with that shown in FIG. 2 of U.S. Pat. No. 4,999,967 to Hoffmann reveals that the upstream conveying unit 3*a* of Hoffmann (this conveying unit employs two endless foraminous band conveyors 3*a*1, 3*a*2 which attract and advance the adjacent marginal portions of the web) is replaced with the conveying unit 8 having a single endless belt 11 which engages the intermediate portion of the web 1 upstream of the conveying unit 9 which latter is or can be identical with the conveying unit 3*b* of Hoffmann. It has been ascertained that, quite surprisingly, such modification of (i.e., departure from) the proposal of Hoffmann brings about a number of desirable and important advantages. Thus, the transfer of successive blanks 3 to the foraminous bands 16, 17 of the conveying unit 9 in the apparatus of the present invention takes place without the development of wrinkles, fold lines and similar undesirable deformations which would affect the appearance as well as the quality of envelopes constituting converted blanks 3. Moreover, the absence of wrinkles and similar undesirable deformations of the web 1 in the apparatus of the present invention ensures a more predictable advancement of successive blanks into the range of successive oncoming packets 4.

It is believed that the pronounced improvement in the advancing action of the conveying units 8, 9 (as compared with that of the conveying units 3*a*, 3*b* in the apparatus of Hoffmann) is attributable to lack of accurate alignment between the foraminous bands 3*a*1, 3*a*2 of the conveying unit 3*a* and the foraminous bands 3*b*1, 3*b*2 of the conveying unit 3*b* in the apparatus of Hoffmann. Moreover, it is assumed that the slip between the web 1 and the bands 3*a*1, 3*a*2 in Hoffmann's apparatus departs from the slip between the web and the bands 3*b*1, 3*b*2, and this also contributes to the development of wrinkles especially if the web which is being advanced in the apparatus of Hoffmann is rather thin and hence very prone to deformation. All such drawbacks of the patented apparatus are overcome by the positioning of the single foraminous belt 11 of the conveying unit 8 in the improved apparatus adjacent an intermediate portion of the running web 1.

The cross cutter 22 comprises a rotary cutting tool 23 at one side and a stationary counterknife 24 at the other side of the path for the web 1 between the conveying units 8 and 9.

Since the blanks 3 are assumed to be converted into transparent outer envelopes for the respective packets 4, they are or they can be provided with customary tear strips to permit rapid and convenient separation of converted blanks 3 (outermost envelopes) from the respective packets 4. As a rule, a cut into the blank 3 indicates the locus of the manually engageable end of the respective tear strip. The single FIGURE does not show the tear strips but it does illustrate a cutter 26 which is provided to form the aforementioned cuts. The cutter 26 is located ahead of the advancing rollers 6*a,* 6*b* and comprises a rotary severing tool 27 at one side and a pressure applying or biasing roll or counterknife 28 at the other side of the web 1 opposite the tool 27. Other types of cutters can be employed with equal advantage. The severing tool 27 is provided with a substantially U-shaped cutting edge (not shown) which cooperates with the roll 28 and provides spaced-apart portions of the web 1 with suitable cuts which afford access to the respective tear strips.

A common prime mover 29 is preferably provided to drive the rotary tools 23, 27 in synchronism with each other.

The reference character 31 denotes a path for a reciprocable pusher 32 which can advance successive packets 4 of a series of such packets across the path for successive blanks 3 at the station 2. The pusher 32 and a draping means (mouthpiece) 34 form part of the means for converting successive blanks 3 into outermost envelopes or wrappers for arrays of plain or filter cigarettes in successive packets 4. The arrow 33 indicates the direction of forward movement of the pusher 32 when the latter advances a packet 4 along the path 31 against one side of a blank 3 which is then located between and the vertical or upright marginal portions of which are then attracted by the adjacent upright reaches of the foraminous bands 16 and 17. The mouthpiece 34 surrounds a portion of the path 31 at those sides of successive blanks 3 which face away from the bands 16 and 17.

A packet 4 and a partially converted blank 3 which is being advanced by such packet beyond the mouthpiece 34 are introduced into the then adjacent chamber or pocket of an indelible turret of the packing machine which embodies or cooperates with the improved apparatus. Reference may be had to the turret 14 which is shown in FIG. 1 of the commonly owned U.S. Pat. No. 4,999,967 to Hoffmann. The manner in which the partially converted blanks 3 are further treated downstream of the mouthpiece 34 (so that each such blank is converted into an envelope fully surrounding the respective packet 4) forms no part of the present invention.

The conveying unit 8 further comprises means 36 for biasing the intermediate portion of the running web 1 against the adjacent upright reach or stretch of the foraminous belt 11. The biasing means 36 can constitute a modified version of the biasing roller 28 or it can comprise a driven or idler belt (not shown) opposite the belt 11.

The single FIGURE shows that the pusher 32 serves to advance successive packets 4 (with cigarettes already confined therein) against successive blanks 3. However, and especially if the web is made of a metallic foil (such as alumium foil), the pusher 32 or an equivalent or more suitable implement can be used to push arrays of unwrapped cigarettes against successive metallic blanks between the bands 16, 17 before the partially confined arrays of cigarettes are introduced (with the respective metallic blanks) into so-called hinged lid packs. Save for the nature of the web and for the nature of commodities which are being advanced along the path 31 across the path for successive metallic blanks, the operation of the improved apparatus in a machine for confining arrays of cigarettes in hinged lid packs is the same as the aforedescribed operation of the apparatus which is shown in the single FIGURE and is designed to confine successive packets 4 in blanks 3 of transparent plastic sheet material.

An important advantage of the improved apparatus is that, by replacing the upstream conveying unit 3*a* of Hoffmann with the upstream conveying unit 8 of the present invention, one eliminates numerous problems in connection with the transfer of successive increments of the running web from the upstream conveying unit into the range of the downstream conveying unit. In addition, the web is less likely to develop wrinkles, fold lines and/or other deformations which could affect its appearance, the appearance of packets as well as the quality of the sealing action of envelopes made of the blanks. Moreover, the advancement of the web and/or of the blanks in the critical region between the two conveying units is much less likely to be disturbed (i.e., irregular or unsatisfactory) than in heretofore known apparatus.

The utilization of discrete drive means (14 and 21) for the two conveying units 8, 9 constitutes an optional but highly desirable and advantageous feature of the improved apparatus because the adjustability of the speed of the belt 11 independently of the speed of the bands 16, 17 and/or vice versa further reduces the likelihood of unsatisfactory advancement and the resulting likelihood of deformation of the web 1. In addition, and if the advancing means 6*a*, 6*b* and/or the cutter 26 and/or the conveying unit 8 and/or the cross cutter 22 happens to malfunction, the conveying unit 9 can be utilized to evacuate discrete blanks 3 or accumulations of several blanks from the station 2. Analogously, the conveying unit 9 can be put to use to evacuate from the station 2 one or more blanks 3 in the event of malfunctioning of the means (32) for supplying packets 4 or arrays of unwrapped cigarettes to the station 2.

The means for integrating the improved apparatus into a packing machine (such as by resorting to the pusher 32, to the mouthpiece 34 and to the aforementioned indexible turret), too, can be modified in a number of ways without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art of transporting webs of wrapping material and, therefore, such adaptations should and are intended to be comprehended within the meaning and range of equivalence of the appended claims.

What is claimed is:

1. Apparatus for transporting an elongated web having spaced-apart first and second marginal portions and an intermediate portion between said marginal portions in a predetermined direction along a predetermined path, comprising a first conveying unit including first and second driven endless pneumatic band conveyors adjacent and arranged to advance the respective marginal potions of the web by suction in said direction along a first portion of said path; a second conveying unit adjacent a second portion of said path entirely upstream of said first portion, as seen in said direction, and arranged to engage and entrain in said direction said intermediate portion of the web; and a cross cutter for the web in said path, said cross cutter being located downstream of said second conveying unit and upstream of said first conveying unit and being operative between said first and second portions of said path.

2. The apparatus of claim 1, wherein said second conveying unit engages the intermediate portion at least substantially midway between the marginal portions of the web in said path.

3. The apparatus of claim 1, wherein the web consists of a packing material for smokers' products.

4. The apparatus of claim 1, wherein said units form part of a packing machine for smokers' products.

5. The apparatus of claim 1, wherein said second conveying unit is disposed at one side of the intermediate portion of the web in said second portion of said path and further comprising means for biasing the intermediate portion of the web in said second portion of said path against said second conveying unit.

6. The apparatus of claim 5, wherein said means for biasing is located at the other side of the intermediate portion of the web in said second portion of said path.

7. The apparatus of claim 1, wherein said second conveying unit comprises at least one endless belt having a web-contacting reach adjacent the intermediate portion of the web in said second portion of said path and arranged to advance the web toward said first portion of said path.

8. The apparatus of claim 7, wherein said reach is elongated and extends in said predetermined direction.

9. The apparatus of claim 8, wherein said at least one endless belt of said second conveying unit is foraminous and said second conveying unit further comprises means for pneumatically attracting the intermediate portion of the web in said second portion of said path to said foraminous belt.

10. The apparatus of claim 9, further comprising first drive means for the conveyors of said first conveying unit and discrete second drive means for the at least one endless belt of said second conveying unit.

11. The apparatus of claim 1, wherein said first portion of said path immediately follows said second portion of said path.

12. The apparatus of claim 1, wherein said cutter is operative to sever the web at predetermined intervals so that the web yields a series of successive blanks, and further comprising means for converting successive blanks into wrappers for arrays of rod-shaped articles.

13. The apparatus of claim 12, wherein said converting means comprises means for advancing successive arrays of a series of arrays against successive blanks of said series of blanks along a second path extending across said first portion of said predetermined path.

14. The apparatus of claim 13, wherein said converting means further comprises means for draping successive blanks of said series of blanks around the respective arrays in said second path.

15. The apparatus of claim 13, wherein the arrays of rod-shaped articles are groups of cigarettes confined in packets which are to be draped into said blanks.

16. The apparatus of claim 13, wherein the arrays are groups of cigarettes to be confined in the respective blanks.

* * * * *